US009528298B2

(12) United States Patent
Osvatic

(10) Patent No.: US 9,528,298 B2
(45) Date of Patent: Dec. 27, 2016

(54) APPLIANCE LATCH WITH UNI-DIRECTIONAL ACTUATOR

(71) Applicant: Illinois Tool Works Inc., Glenview, IL (US)

(72) Inventor: Michael S. Osvatic, Waukesha, WI (US)

(73) Assignee: Illinois Tool Works, Inc., Glenview, IL (US)

( * ) Notice: Subject to any disclaimer, the term of this patent is extended or adjusted under 35 U.S.C. 154(b) by 191 days.

(21) Appl. No.: 14/322,302

(22) Filed: Jul. 2, 2014

(65) Prior Publication Data

US 2015/0021929 A1 Jan. 22, 2015

Related U.S. Application Data

(60) Provisional application No. 61/847,210, filed on Jul. 17, 2013.

(51) Int. Cl.

| | |
|---|---|
| ***E05C 1/06*** | (2006.01) |
| ***E05B 47/02*** | (2006.01) |
| ***E05B 15/10*** | (2006.01) |
| ***D06F 39/14*** | (2006.01) |
| *E05B 47/00* | (2006.01) |

(52) U.S. Cl.

CPC ..... *E05B 47/026* (2013.01); *D06F 39/14* (2013.01); *E05B 15/101* (2013.01); *E05B 47/0012* (2013.01); *E05B 2047/002* (2013.01); *E05B 2047/0035* (2013.01); *E05B 2047/0068* (2013.01); *E05B 2047/0069* (2013.01); *Y10T 292/1021* (2015.04)

(58) Field of Classification Search

CPC ... A47L 15/4259; Y10S 292/69; Y10S 292/04
USPC ..... 292/144, DIG. 65
See application file for complete search history.

(56) References Cited

U.S. PATENT DOCUMENTS

| | | | | |
|---|---|---|---|---|
| 4,383,707 | A * | 5/1983 | Nishimura | E05C 19/022 292/110 |
| 5,520,424 | A | 5/1996 | Hapke et al. | |
| 5,823,017 | A | 10/1998 | Hapke et al. | |
| 6,255,934 | B1 * | 7/2001 | Gadini | G05D 23/1921 236/59 |
| 6,363,755 | B1 | 4/2002 | Hapke et al. | |
| 7,493,783 | B2 | 2/2009 | Hapke et al. | |
| 2008/0099314 | A1 | 5/2008 | Krieger et al. | |
| 2010/0052338 | A1 | 3/2010 | Osvatic et al. | |
| 2013/0106541 | A1 * | 5/2013 | Naruo | H01H 13/568 335/166 |

* cited by examiner

*Primary Examiner* — Mark Williams
(74) *Attorney, Agent, or Firm* — Boyle Fredrickson, S.C.

(57) ABSTRACT

A door locking mechanism for an appliance provides a bolt that is biased by a spring but may be moved by a unidirectional actuator. A bi-stable mechanism blocks movement of the bolt at certain positions at successive actuations of the unidirectional actuator. In this way, energy need not be provided to the electromechanical actuator except periodically.

18 Claims, 9 Drawing Sheets

APPLIANCE LATCH WITH UNI-DIRECTIONAL ACTUATOR

CROSS REFERENCE TO RELATED APPLICATIONS

This application claims the benefit of U.S. provisional application 61/847,210 filed Jul. 17, 2013 and hereby incorporated by reference

FIELD OF THE INVENTION

The present invention relates to clothes washing machines and the like, and specifically to a lid locking mechanism.

BACKGROUND OF THE INVENTION

The spin cycle of a washing machine removes water centrifugally from wet clothes by spinning the clothes at high speed in a spin basket. In order to reduce the possibility of injury to the user during the spin cycle, it is known to use an electronically actuated lock for holding the washing machine lid in the closed position. U.S. Pat. Nos. 6,363,755; 5,823,017; and 5,520,424, assigned to the present assignee and hereby incorporated by reference, describe several locking mechanisms. Desirably, the locking mechanism minimizes projecting parts on the washing machine lid which might snag clothing or reduce access to the spin basket and is simply integrated into the washing machine housing.

A signal indicating the state of the washing machine lid as opened or closed may be used to ensure the lid is closed before the lock is engaged. Such a signal may be provided by a switch communicating with the washing machine lid. Ideally such a switch could not be easily defeated, would operate reliably when used with other washing machine components with normal manufacturing tolerances, and would be resistant to contamination by water and dirt.

U.S. Pat. No. 7,493,783, hereby incorporated by reference, describes a lid lock that can sense whether the lid is closed by distinguishing between an "over-travel" position of the lock bolt that can occur when the lock bolt is extended and the lid is up and so does not block the extension of the lock bolt, and an "engagement" position of the lock bolt that occurs when the lid is down and the lock bolt is received by the lid blocking overextension. A controller, by distinguishing between three electrical signals indicating, respectively, the unlock position, the over-travel position, and the lock position, can determine that the door is properly locked with the lid engaging the lock bolt.

U.S. provisional application 61/711,418 filed Oct. 9, 2012, and hereby incorporated by reference, describes a lock bolt actuator employing a mechanical element responding to successive pairs of forward followed by reverse actuation from a bidirectional electric actuator, such as a motor, to provide three distinct lock bolt positions (unlock, lock and over-travel position) depending on the presence or absence of the lid. The lock position is blocked against retracting when an external inward force is applied on the bolt. A unique signal indicating that the bolt is either in the engaged position or over-travel position combined with controller logic allows the appliance controller to determine if the lid is closed and locked with only one binary signal.

SUMMARY OF THE INVENTION

The present invention provides an improved lock bolt actuator that avoids the need for a bidirectional electrical actuator and which ensures full locking engagement between the bolt and lid despite bolt "bounce back", lid spacing tolerances, and machine vibration. These benefits are obtained by incorporating a spring into the bolt mechanism that biases the bolt outward to fully engage the lid for a variety of bolt extensions and providing a two-state mechanical element that may alternatively release the bolt for a range of motion locking engagements or hold the bolt in the unlock position with successive unidirectional activations by a motor or solenoid. The ability to use a unidirectional actuator allows the actuator to be freely selected from among DC motors, AC motors, and solenoids.

In one embodiment, the present invention provides an electric lock for a household appliance having a door where the door can be locked in a closed position by receipt of a bolt extending along an axis from an appliance frame into the door. The electric lock includes a housing to attach to the appliance frame and a bolt that may extend from the housing to a lock position to lock the door and retract into the housing to an unlock position to unlock the door. An electromechanical actuator operates to receive an electrical signal to apply a force to the bolt opposing a spring, the latter which may move the bolt when the electromechanical actuator is not actuated. A bi-stable mechanical linkage is attached to the bolt to hold the bolt at a stable position resisting movement by the spring and then to release the bolt from the stable position allowing movement by the spring with successive actuation of the electromechanical actuator.

It is thus a feature of at least one embodiment of the invention to provide for a spring driven "homing" of the bolt when the electromechanical actuator is not actuated provide greater certainty in bolt position.

The electromechanical actuator may operate only to provide force counter to the force of the spring.

It is thus a feature of at least one embodiment of the invention to permit use of a unidirectional actuator that may be more simply controlled with fewer control wires.

The spring may move the bolt along the axis in extension and wherein the bi-stable actuator operates to release the bolt to extend beyond the unlock position upon a first actuation and following a first deactivation of the electromechanical actuator, and may hold the bolt at the unlock position upon a second actuation and following second deactivation of the electromechanical actuator.

It is thus a feature of at least one embodiment of the invention to provide a spring loading to the bolt that retains the bolt fully in the lock position despite possible actuator bounce back caused by impact of the bolt and the lid and through a range of lid location tolerances and during appliance vibration when the actuator is de-energized.

In an alternative embodiment, the spring may move moves the bolt along the axis in retraction and the bi-stable actuator may operate to hold the bolt at the lock position upon a first actuation and following a first deactivation of the electromechanical actuator, and to release the bolt to retract to the unlock position upon a second actuation and following second deactivation of the electromechanical actuator.

It is thus a feature of at least one embodiment of the invention to provide a bolt that will automatically retract when the door is not in the closed position.

Upon release by the bi-stable mechanical linkage, the bolt may extend to an over-travel position beyond the lock position when the door is not in the closed position, whereas the bolt may extend only to the lock position when the door is in the closed position.

It is thus a feature of at least one embodiment of the invention to provide a method of detecting lid closure using measured bolt extension. If the bolt extends to the over-travel position, it can be inferred that the lid is not closed. In this regard, the invention may eliminate the need for separate lid closure sensors or provide backup to such sensors The electric lock may include contacts providing an electrical signal distinguishing between whether the bolt is in the lock position or over-travel position.

It is thus a feature of at least one embodiment of the invention to provide an electrical signal that may be used to lockout some appliance functions in the event that the lid is not closed.

The contacts may be closed when the bolt is in the lock position and not when the bolt is in the over-travel position.

It is thus a feature of at least one embodiment of the invention to provide a system where contact failure indicates a door reducing the chance that such failure would promote unsafe appliance operation.

The electric lock may include a controller providing the electric signal to the electromechanical actuator to operate the electromechanical actuator only to provide a force urging the bolt in retraction and not a force urging the bolt in extension.

It is thus a feature of at least one embodiment of the invention to provide a system that may use unidirectional or bidirectional electromechanical actuators. In this regard, the invention allows greater flexibility in selecting an actuator and simplifies the generation of control voltages.

The spring may be sized to move the bolt in extension from the unlock position when the electromechanical actuator is not activated and the bolt is not held by the bi-stable mechanical linkage at the unlock position.

It is thus a feature of at least one embodiment of the invention to permit the electromechanical actuator to be turned off during most of the operating time of the appliance for power savings while retaining lock functionality.

The bi-stable mechanical linkage may provide a track and track-follower fixed, respectively, to one of the bolt and housing, the track follower interacting with the track to stably hold the bolt against the spring in the unlock position upon the first actuation and following the first deactivation.

It is thus a feature of at least one embodiment of the invention to provide for a simple bi-stable mechanism that permits a range of over-travel positions.

The follower may be a tip of a flexible spring.

It is thus a feature of at least one embodiment of the invention to provide a simple follower resistant to binding.

The track may be a groove in the bolt.

It is thus a feature of at least one embodiment of the invention to minimize the size of the housing by placing the track on the bolt itself.

The electromechanical actuator may be an electric motor, for example, a DC permanent magnet motor.

It is thus a feature of at least one embodiment of the invention to permit use of a rapid response low noise, energy efficient electromagnetic actuator.

The contacts may include only a single contact, pair allowing determination only of whether the bolt is in the lock position so that the electrical signal distinguishes between whether the bolt is in the unlock position or over-travel position.

It is thus a feature of at least one embodiment of the invention to reduce the wiring harness necessary between an electric lock and a controller.

Alternatively, the electric lock may include second contacts providing an electrical signal distinguishing between whether the bolt is in the unlock position or over travel position.

It is thus a feature of at least one embodiment of the invention to positively identify the location of the bolt between the lock, unlock, and over-travel positions.

These particular objects and advantages may apply to only some embodiments falling within the claims and thus do not define the scope of the invention. Other features and advantages of the invention will become apparent to those skilled in the art upon review of the following detailed description, claims and drawings in which like numerals are used to designate like features.

Figure 1:
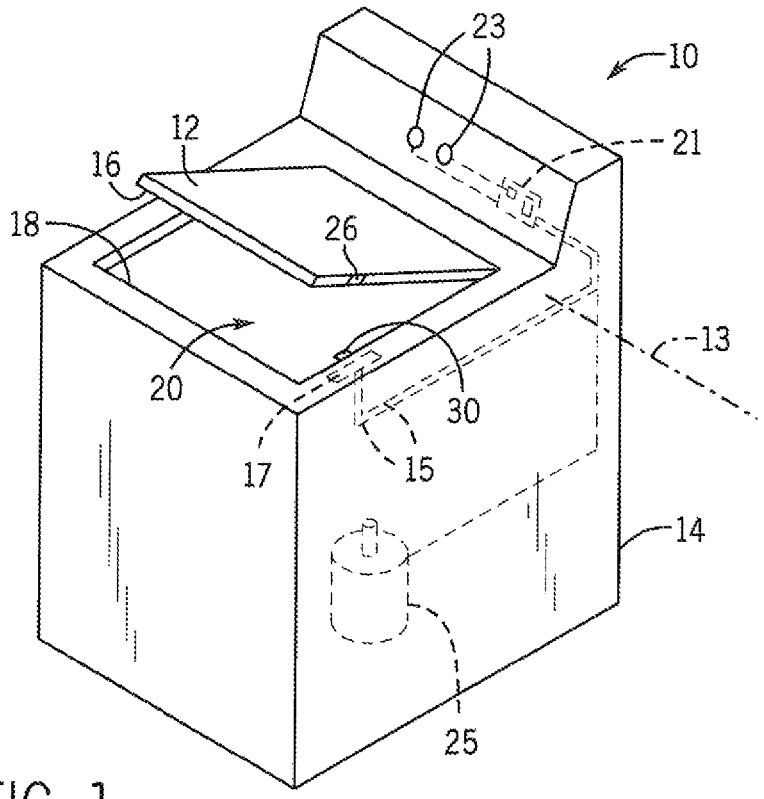
FIG. 1 is a perspective view of a top loading washing machine suitable for use with the present invention showing a strike opening on a side of the opened lid of the washing machine and an electric lock having a bolt for engaging the same when the lid is closed and showing a controller on the console.

Before the embodiments of the invention are explained in detail, it is to be understood that the invention is not limited in its application to the details of construction and the arrangement of the components set forth in the following description or illustrated in the drawings. The invention is capable of other embodiments and of being practiced or being carried out in various ways. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof.

DETAILED DESCRIPTION OF THE PREFERRED EMBODIMENTS

Referring now to FIG. 1, an appliance 10, such as a top loading washing, machine suitable for use with the present invention, includes a lid 12 opening upward about a horizontal lid hinge axis 13. The lid hinge axis 13 is positioned near the top rear edge of a housing 14 of the appliance 10 so that a front edge 16 of the lid 12 may raise and lower to expose and cover an opening 20 through which clothing may be inserted into the spin basket. The present invention may also be used with a frontloading washing machine or other similar appliances 10 as will be understood from the following description.

An electric lock 17 may be attached to the housing 14 and may provide for a bolt 30 that may be extended from the housing 14 into a strike opening 26 in the lid 12 to lock the lid 12 when the lid 12 is closed, conversely, an electric signal may retract the bolt 30 into the housing 14 to allow the lid 12 to be freely opened after locking.

The electric lock 17 may communicate electrically via at least one conductive circuit 15 to a controller 21, for example, positioned at a rear console of the housing 14. The controller 21 may also provide for electrical communication with various user controls 23 as is understood in the art and with electrical machinery 25 such as an agitator motor or the like to control the same. In this regard, the controller 21 may provide an electronic processor for executing an appliance control program held in a non-transient media such as computer memory.

Figure 2:
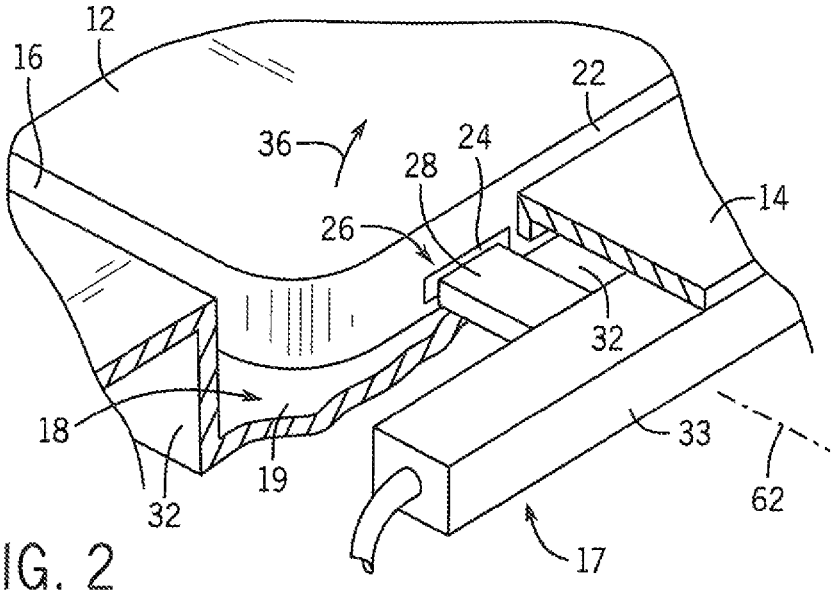
FIG. 2 is a fragmentary cutaway of the portion of the lid and washing machine near the bolt of FIG. 1 showing support of a locking mechanism beneath a lid well.

Referring now to FIG. 2, in this example, when the lid 12 is in the closed position, it may sit within a lid well 18 having vertical walls 32 surrounding vertical walls 22 of the lid 12 and having a horizontal ledge 19 on which the lower surface of the lid 12 may rest. A vertical wall 22 of the lid 12 near a front edge 16 of the lid 12 provides a strike plate 24 having a strike opening 26.

Figure 3:
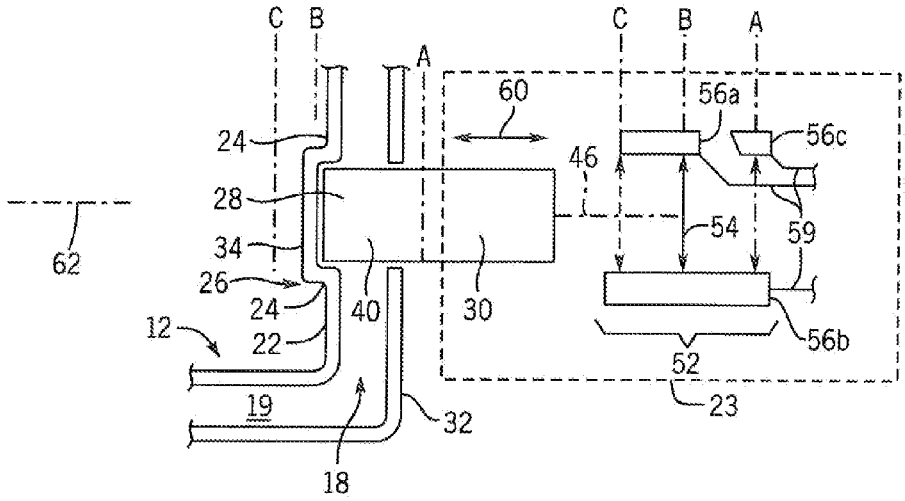
FIG. 3 is a simplified top plan view of the bolt of FIG. 2 extending through a wall of the lid well to engage a strike of the lid and illustrating an unlock position, lock position, and over-travel position of the bolt and further showing corresponding states of an electrical switch having multiple contacts connected to the bolt to provide an indication of bolt position both in the unlock position and lock position.

Referring also to FIG. 3, the strike opening 26 is sized to receive a leading edge 28 of a lateral extension 40 of a bolt 30 passing horizontally out of a lock housing 33 of the electric lock 17 when the lock housing 33 is a fixed to the housing 14 behind the vertical wall 32. The bolt 30 may extend from the lock housing 33 along an axis 62 through an opening in the vertical wall 32 of the lid well 18 opposite the strike plate 24 when the lid 12 is closed. When the leading edge 28 of the bolt 30 is engaged in the strike opening 26, the lid 12 may not be raised vertically as indicated by arrow 36 as a result of the lower edge of the strike opening 26 interfering with a lower face of the leading edge 28. This extension of the bolt 30 will be called the lock position or lock state.

When the lid 12 is closed, the leading edge 28 of the bolt 30 may be blocked from further extension by a stop 34 attached to the lid 12 behind the strike opening 26. When the lid 12 is open, however, the leading edge 28 may move further in extension to an over-travel position as will be described.

Referring now to FIG. 3, as will be discussed in detail below, the bolt 30 communicates via a side arm 46 (shown schematically in FIG. 3) with a contact set 52. The contact set 52 provides a two-throw switch in which a pole 54 (attached to the side arm 46) interconnects between respective terminals 56*a*, 56*b*, and 56*c* fashioned on the upper surface of the printed circuit board contact support element 70 (shown in FIG. 4) fixed with respect to the housing 25.

Terminals 56*a* and 56*b* are joined by the conductive pole 54 in a lock position (B) in which the leading edge 28 engages the bolt hole 26 abutting the stop 34 but disconnects between terminals 56*a* and 56*b* and interconnects between respective terminals 56*c* and 56*b* in the unlock position (A) when the leading edge 28 is removed from the bolt hole 26. In an over-travel position (C) where the leading edge extends beyond the lock position not stopped by the stop 34 when the door 12 is open, the pole 54 also connects to terminal 56*a* and 56*b*. Accordingly, the unlock position can be uniquely identified, but the lock position and the over-travel position cannot be positively distinguished by means of signals conveyed over separate conductors 59 attached to terminals 56*a* and 56*c* (and a common conductor attached to terminal 56*b*) conveying two signals of lock signal 96 and unlock/over-travel signal 91.

In a second embodiment, the contact set 52 implements a two-throw switch in which a pole 54 interconnects between respective terminals 56*a* and 56*b* in the lock position (B) in which the leading edge 28 engages the strike opening 26 abutting the stop 34. Terminals 56*a* and 56*b* are otherwise disconnected when the bolt 30 is in other positions including both the unlock position (A) when the leading edge 28 is removed from the strike opening 26 and the over-travel position (C) where the leading edge extends beyond the lock position not stopped by the stop 34 when the lid 12 is open. In one embodiment, the contact set 52 comprises only terminals 56*a* and 56*b*. In this embodiment, only a lock position can be positively determined and the over-travel and unlock positions cannot be distinguished by terminals 56*a* and 56*b*.

In a third embodiment, a terminal 56*c* may be added where the pole 54 connects terminal 56*c* and terminal 56*b* only when the bolt is in the unlock position (A). It will be appreciated that this added terminal 56*c* allows the position of the bolt to be positively located in any one of the positions (A), (B) and (C). Accordingly, each of the lock, unlock, and over-travel positions can be positively determined and distinguished.

Bolt with Extension Biasing

Figure 4:
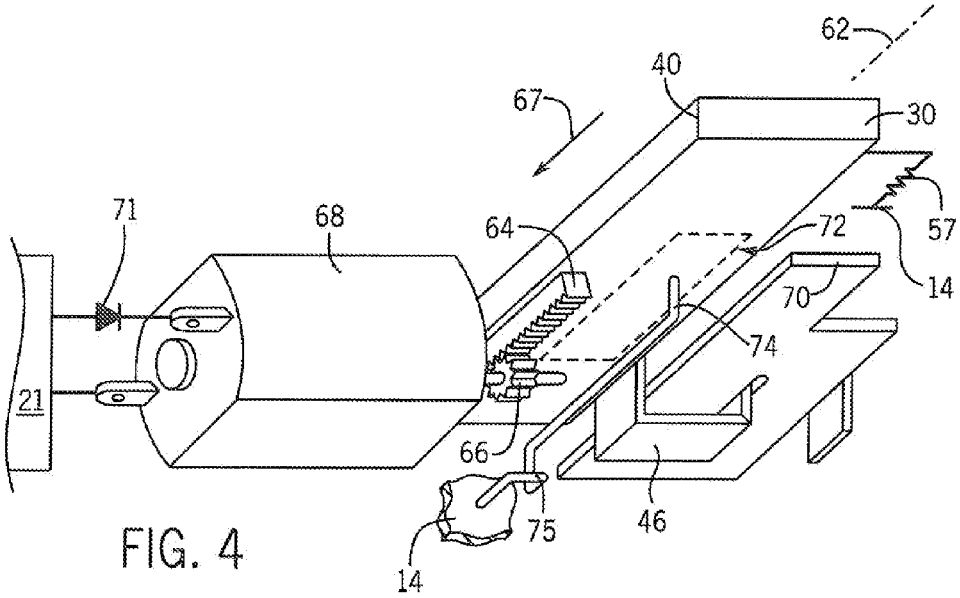
FIG. 4 is a perspective view of an electric motor and rack and pinion mechanism for extending and retracting the bolt and showing a track and wire-follower controlling a resting position of the bolt in two states.

Referring now to FIG. 4, the bolt 30 may be driven along axis 62 in an retraction direction 67 by means of a rack gear 64 positioned on a lower surface of the bolt 30 driven by a pinion 66 turned by an electromechanical actuator 68 such as a DC motor operating in a unidirectional mode and capable of applying a force on the bolt 30 urging it to retract along axis 62 in the retraction direction 67 away from the lid 12 (as shown in FIG. 3). In this regard, the DC motor may receive only a single polarity of voltage, for example, a DC voltage or a DC signal derived from an AC signal after it is rectified by a diode 71 (as shown). It will be appreciated that the electromechanical actuator 68 may alternatively be an AC motor (with the diode 71 removed), electrical solenoid, or other known electromechanical actuators.

As will be described in more detail below, the bolt 30 may also attach to a spring 57 between the bolt 30 and the housing 14 urging the bolt 30 in an extension direction opposite the retraction direction 67 along axis 62. The spring 57 may be, for example, a helical compression spring and may exert a force on the bolt 30 sufficient to move the bolt 30 to override the electromechanical actuator 68 when the latter is not electrically actuated. That is, the spring 57 may overcome the frictional forces presented by the un-energized electromechanical actuator 68 and other interconnecting and supporting structures. It will likewise be appreciated that the electromechanical actuator 68, when actuated by an electrical current, may overcome the force of the spring 57 and any friction of the interconnecting mechanism and support structure.

Referring still to FIG. 4, side arm 46 communicating between the bolt 30 and the contact set 52 may extend from a lower surface of the bolt 30 and pass in cantilevered fashion under a contact support element 70 forming part of the contact set 52 described above. A track 72 formed by a groove on the under surface of the bolt 30 receives an upwardly extending pin 74 being part of a wire form 75 attached to a housing 14 that may flex laterally generally perpendicular to axis 62. The pin 74 fits in the groove of the track 72 to constrain motion of the bolt 30 as driven by the actuator 68. When the motion of the bolt 30 in the retraction direction 67 is constrained by the pin 74, as discussed below, the electromechanical actuator 68 may simply stall for a short period of time and is current limited (for example, by internal resistance) to allow the stall condition to be accommodated. In this way the actuator 68 may be driven in an "open-loop fashion" by an appliance controller 21 (shown in FIG. 1).

Figure 5:
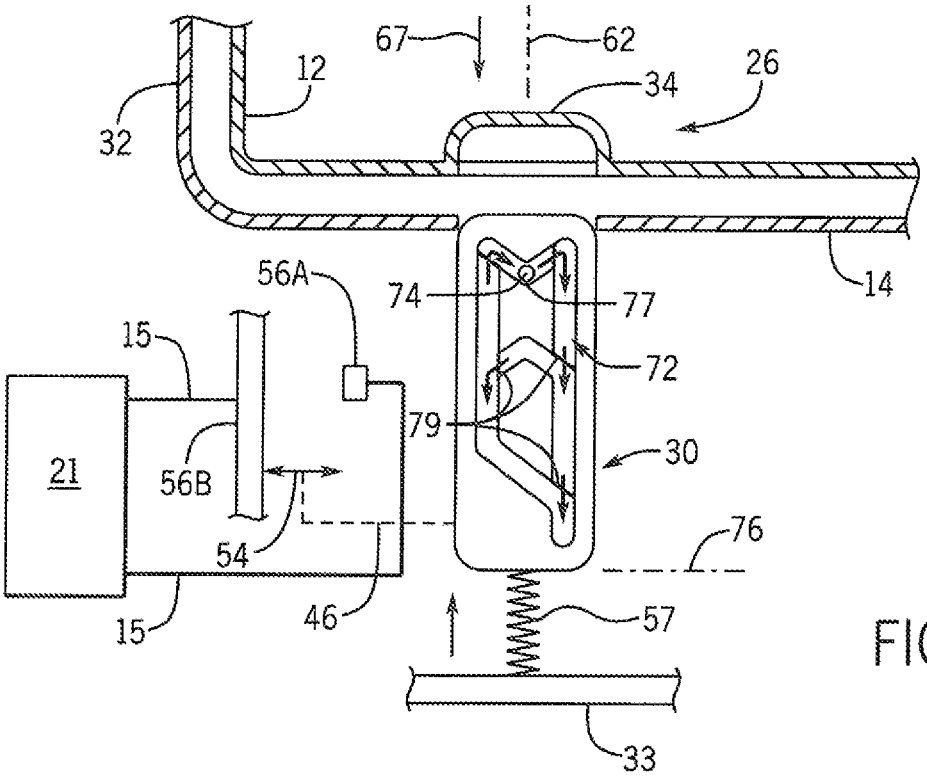
FIG. 5 is a diagram of the position of the track and bolt with respect to the wire-follower for a full retraction (unlock) state.

Referring now to FIG. 5, with the bolt 30 in the unlock position 76, fully withdrawn from the lid 12, the pin 74 will be at a distal end of the bolt 30 and the track 72. The bolt 30 will be biased outward along axis 62 (opposite the retraction direction 67) by the spring 57 but will not move outward because the pin 74 presses stably against a trough 77 of the track 72. At this position, the pole 54 connects to terminal 56*b* but not to terminal 56*a* and so a lock signal is not provided to the appliance controller. The track 72 provides a series of ledges 79 that enforce one-way travel of the pin 74 through the track 72 by causing the pin 74 to spring upward as it passes over the ledge 79 so that reverse travel is blocked by the ledge wall.

Figure 6:
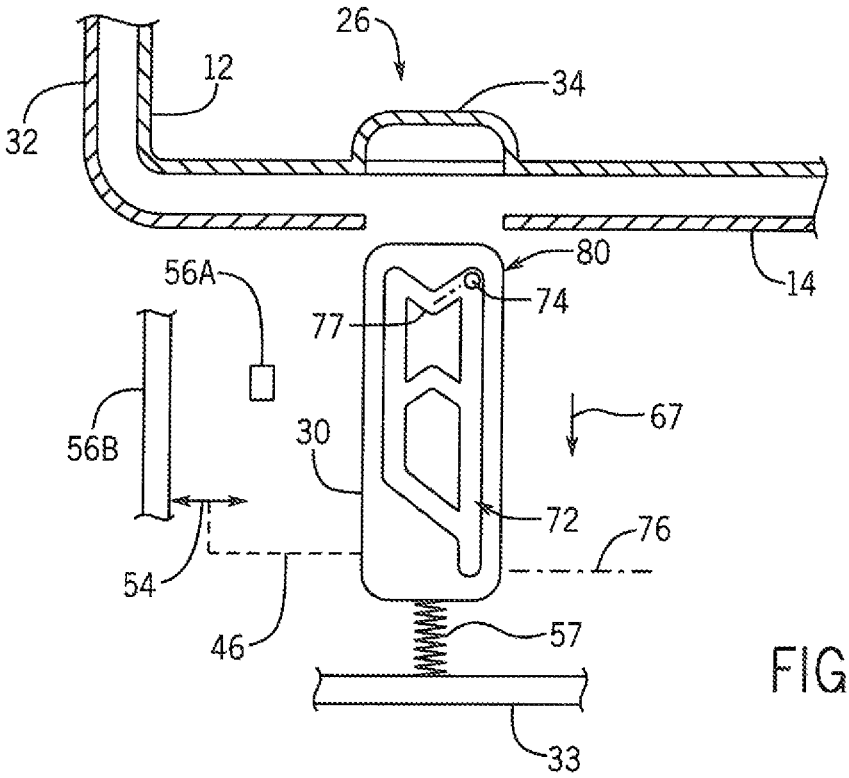
FIG. 6 is a figure similar to FIG. 5 showing a position of the track and bolt after a first unidirectional actuation from the state of FIG. 5.

Referring to FIG. 6, a pulse of current on the electromechanical actuator 68 (shown in FIG. 4) provided by a central controller 21 will then cause the bolt 30 to move in the retraction direction 67 moving the pin 74 away from its resting position on the trough 77 up to a right-hand side 80 of the track 72 as indicated by the dotted line. Pole 54 is still disconnected from terminal 56*a*.

Figure 7:
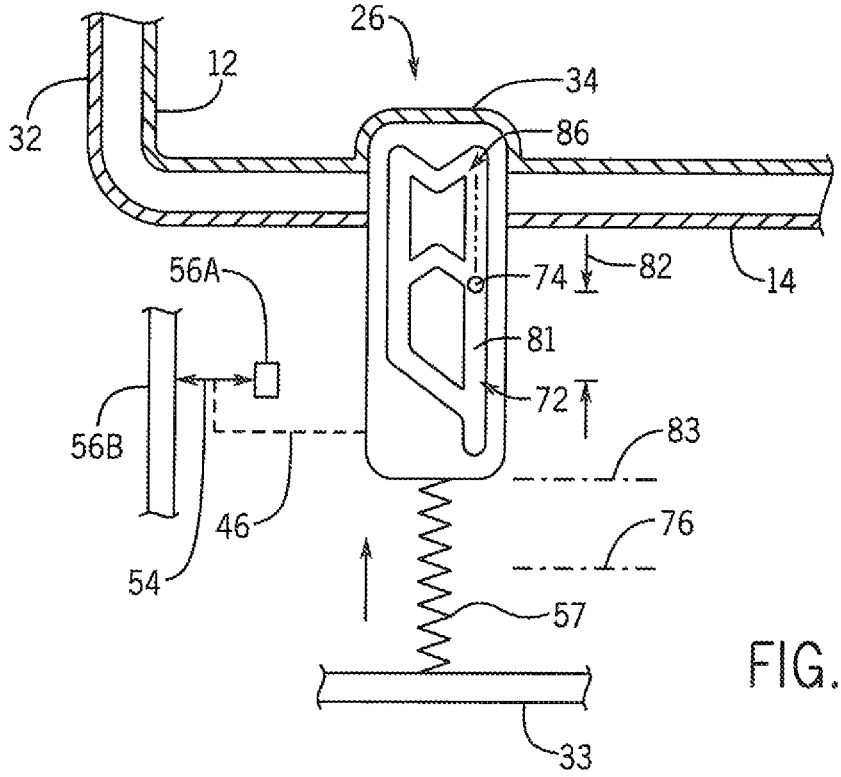
FIG. 7 is a figure similar to FIGS. 5 and 6 after cessation of the unidirectional actuation with the bolt in a full extension engaged (lock) state with the lid such as accommodates a variety of lid housing separations.

Referring to FIG. 7, when the current to the electromechanical actuator 68 ceases, the spring 57 urges the bolt 30 outward and the pin 74 drops from the right-hand side 80 down a central track 81 of the track 72 passing to the rear of the bolt 30 allowing the bolt 30 to extend along axis 62 until it hits the stop 34 in the lid 12 at an lock position 83. The spring biasing ensures that the bolt 30 is fully extended into the strike opening 26 regardless of slight tolerance variations and removing any "bounce back" which can occur with motorized actuators in which flexure and/or inertia cause the bolt to retract slightly after bottoming on the stop 34. The central track 81 extends by a tolerance stack-up distance 82 allowing this full extension of the bolt 30 into the strike opening 26 for a variety of different separations between the lid 12 and the housing vertical wall 32. Terminal 56*a* is sized so that pole 54 connects terminal 56*a* to terminal 56*b* for the full extent of the tolerance stack-up distance 82 to provide a lock signal throughout this range.

Figure 8:
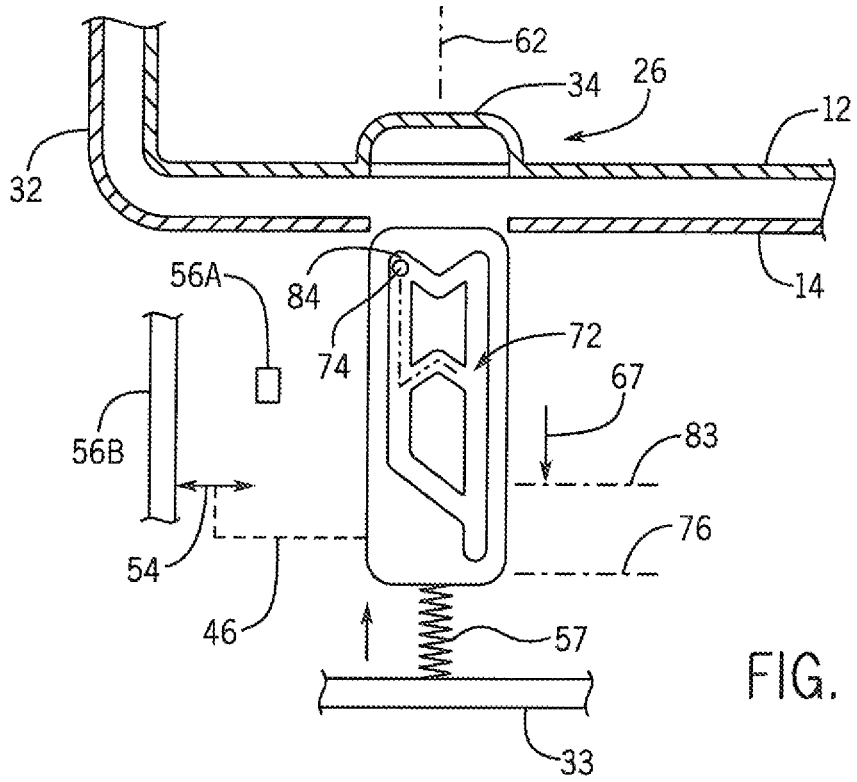
FIG. 8 is a figure similar to FIGS. 5, 6, and 7 showing a return of the track and bolt to the full retraction (unlock) state with a second unidirectional actuation.

Referring now to FIG. 8, a second pulse of current on the actuator 68 will again cause the bolt 30 to move in the refraction direction 67 causing the pin 74 to pass upward to a left-hand lobe 84 of the track 72 and pole 54 to break contact between terminals 56*a* and 56*b* interrupting the lock signal as is appropriate. Cessation of the current to the electromechanical actuator 68 allows the spring 57 to urge the bolt outward so that the pin 74 returns again to the trough 77 as shown in FIG. 5.

It can be seen therefore that successive unidirectional actuations of the actuator 68 when the lid 12 is closed can cause a cycling of the bolt 30 between an unlock position 76 and lock position 83 and that full extension of the bolt 30 into the strike opening 26 may be ensured for a variety of different manufacturing dimension variations.

Figure 9:
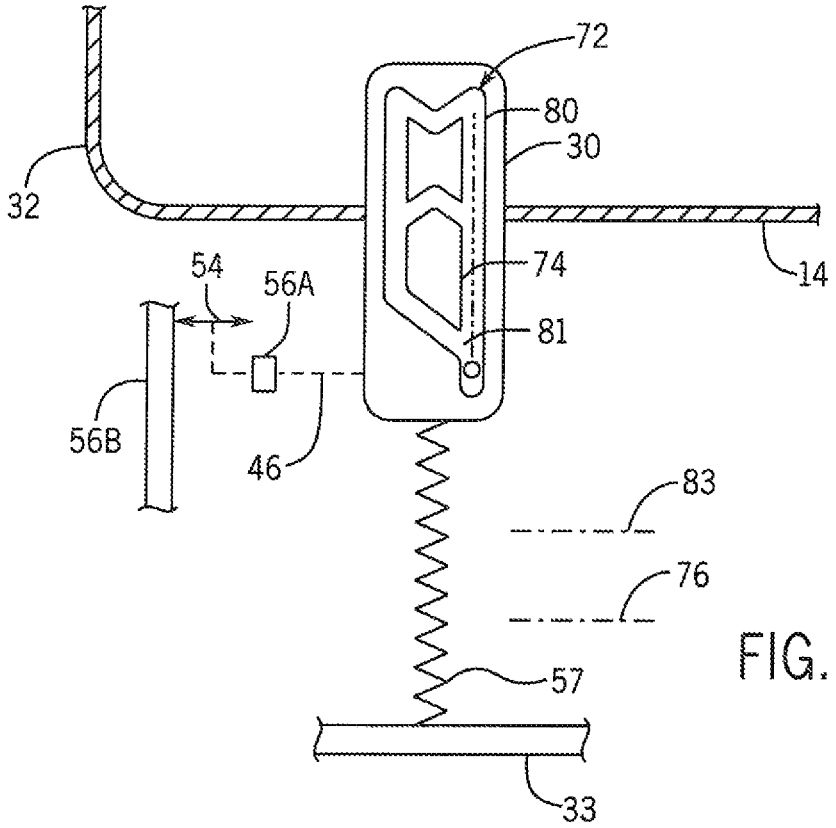
FIG. 9 is a figure similar to FIG. 5 showing over-travel of the bolt after the first unidirectional actuation of FIG. 6 when the lid is open.

Referring now to FIG. 9, if the lid 12 is not closed or if the end of the bolt 30, for example, is broken off, after cessation of the retraction direction 67 of FIG. 6, the bolt 30 will pass outward unimpeded by the stop 34 as driven by spring 57 to beyond the lock position 83. This is allowed because of continuation of central track 81 substantially beyond the distance required for the bolt 30 to extend to the lock position 83. The result is that the pole 54 moves beyond terminal 56*a*, again, breaking any lock signal so as to indicate to the central controller 21 that the lid 12 is not properly locked.

A further actuation of the actuator 68, however, will bring the bolt 30 back to the position shown in FIG. 8 and it may return, to the position of FIG. 5 provided the bolt 30 and the track 72 are preserved.

The pin 74 has been described below as if it is moving relative to the bolt 30 for convenience of description, although in fact, it is the bolt 30 that is moving.

After extension, the bolt 30 may be manually pressed fully in but will no longer indicate a locking, the pin simply moving along the upper right-hand side 80. In this way the actuation of the washing machine may be inhibited in a manner that is difficult to defeat. Generally the lock signal may be used to prevent a starting of an appliance motor such as a washtub motor or the like.

Figure 10:
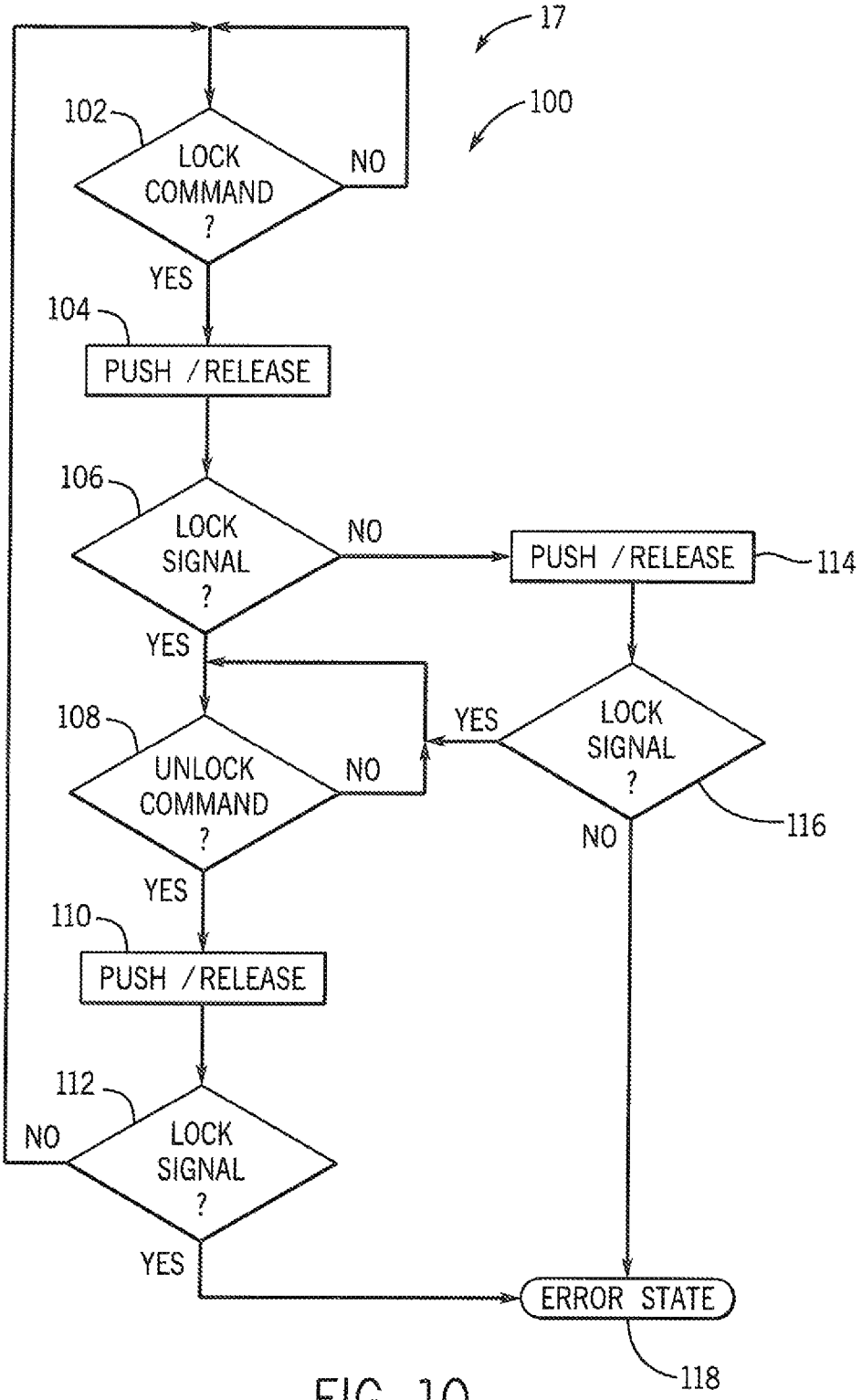
FIG. 10 is a flowchart of a program executed by the controller for control of the electric lock of FIGS. 5-9.

Referring now to FIGS. 3, 4 and 10, as noted above, the controller 21 may include a processor executing a stored program 100 held in computer memory in a non-transient form. The controller 21 may await a lock command from another portion of the program 100, typically triggered by activation of the appliance 10 through user controls 23. When a lock command is detected as indicated by decision block 102, the controller 21 may provide a signal to the electromechanical actuator 68 causing it to apply retraction force in direction 67 to the bolt 30 and then to release that force so that the bolt 30 is moved by the force of the spring 57 in a push/release cycle indicated by process block 104.

Following process block 104, at decision block 106, the controller 21 may check terminal 56*a* to determine if the bolt 30 is in the locked position based on a lock signal received through a single electrical circuit formed with terminals 56*a* and 56*b*. In normal operation, a lock signal will be present and the program 100 proceeds to process block 108 to wait for an unlock command, for example, from another part of the program 100 timing out a wash cycle. Upon receiving the unlock command, the program 100 proceeds to a push/release block 110 identical to process block 104, which causes a retraction of the bolt 30 as described above.

At subsequent decision block 112, program 100 checks to ensure that no lock signal is present (as would be typical), and if this is the case, after the first push/release operation of process block 104 proceeds again to decision block 102 to wait for new lock command.

If at decision block 106 no lock signal is received after the push/release of process block 104, two possibilities exist. One is that the bolt 30 is in the over-travel position (C) and the other is that the bolt 30 is in the retraction position (A) having previously been in the over-travel position, for example, as a result of a power failure or the like which interrupted a previous cycling. To resolve this ambiguity, process block 114 may initiate an additional push/release cycle. The lock signal is then checked at subsequent decision block 116 and if a lock has now been attained, the program proceeds to decision block 108.

If at decision block 116 a lock signal is not present, or if after decision block 112 the lock signal is present, the program 100 proceeds to an error state 118 where functionality of the appliance 10, for example, starting of the agitator motor 25 or the like, is inhibited based on a conclusion that the lid 12 cannot be locked or unlocked as the case may be.

Bolt with Retraction Biasing

Referring again to FIG. 4, in an alternative embodiment, the bolt 30 may be driven along axis 62 in an extension direction 67' by means of the rack gear 64 with the DC motor operating in a unidirectional mode but capable of applying a force on the bolt 30 urging it to extend along axis 62 in the extension direction 67' (shown in FIG. 11) toward from the lid 12 (as shown in FIG. 3). Again, the DC motor may receive only a single polarity of voltage, for example, a DC voltage or a DC signal derived from an AC signal after it is rectified by a diode 71 (as shown). It will be appreciated that the electromechanical actuator 68 may alternatively be an AC motor (with the diode 71 removed), electrical solenoid, or other known electromechanical actuators.

In this embodiment, the bolt 30 may also attach to a spring 57' between the bolt 30 and the housing 14 urging the bolt 30 in a retraction direction opposite the extension direction 67' along axis 62. The spring 57 may be, for example, a helical extension spring and may exert a force on the bolt 30 sufficient to move the bolt 30 to override the electromechanical actuator 68 when the latter is not electrically actuated. That is, the spring 57 may overcome the frictional forces presented by the un-energized electromechanical actuator 68 and other interconnecting and supporting structures. It will likewise be appreciated that the electromechanical actuator 68, when actuated by an electrical current, may overcome the force of the spring 57 and any friction of the interconnecting mechanism and support structure.

Figure 11:
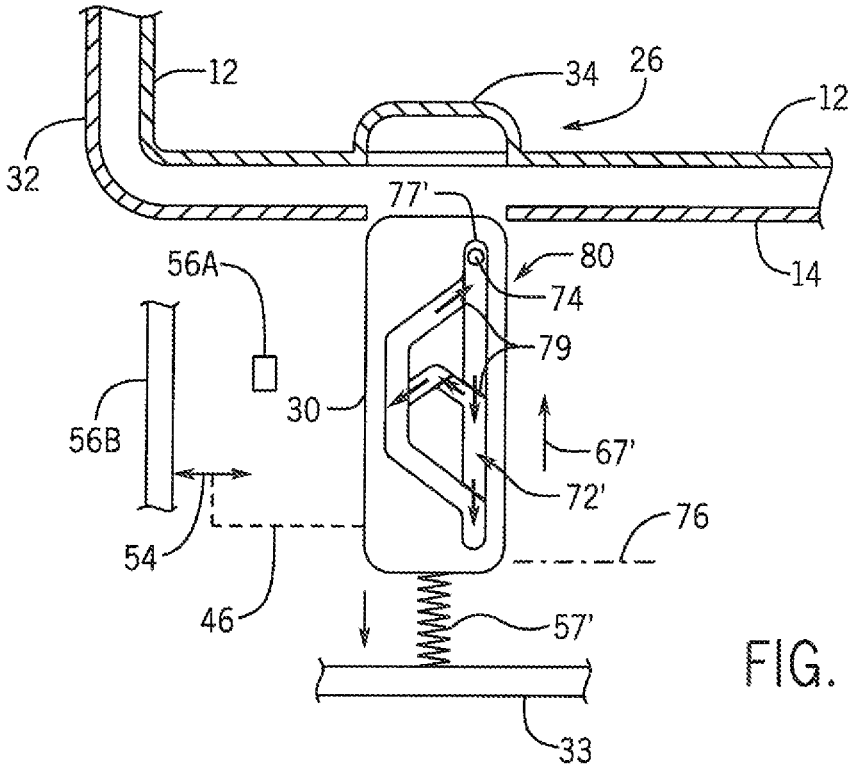
FIG. 11 is a figure similar to that of FIG. 5 showing alternative track designed for use with a retraction spring showing the bolt in the unlock position.

Referring now to FIG. 11, with the bolt 30 in the unlock position 76, fully withdrawn from the lid 12, the pin 74 will be at a distal end of the bolt 30 and the track 72. The bolt 30 will be biased inward along axis 62 (opposite the extension direction 67') by the spring 57 but will not move inward because the pin 74 presses stably against a trough 77' of the track 72'. At this position, the pole 54 connects to terminal **56*b* but not to terminal 56*a* and so a lock signal is not provided to the appliance controller. Again, the track 72' provides a series of ledges 79 that enforce one-way travel of the pin 74 through the track 72' by causing the pin 74 to spring upward as it passes over the ledge 79** so that reverse travel is blocked by the ledge wall.

Figure 12:
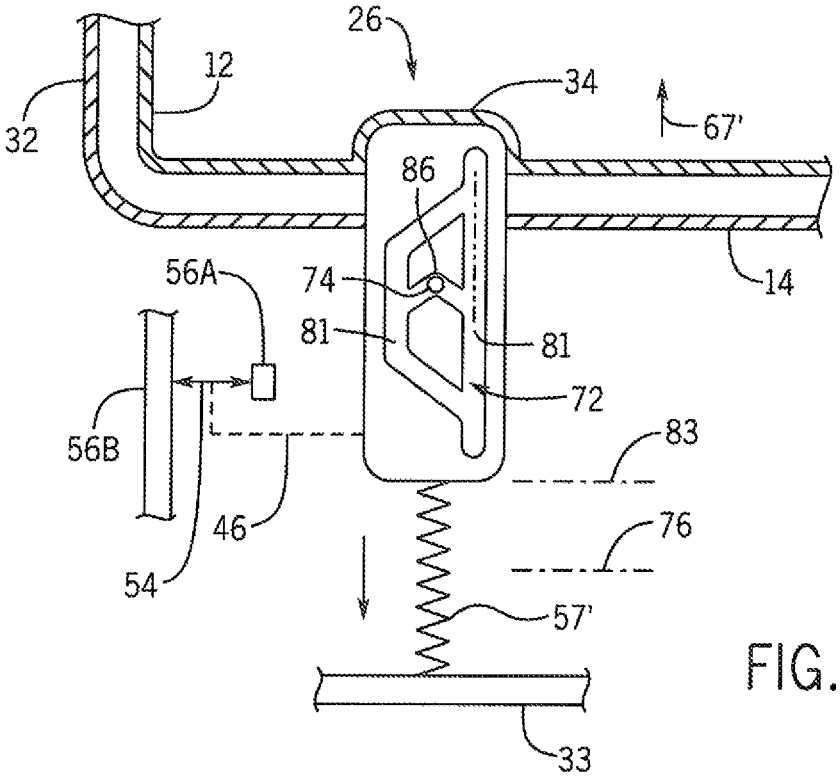
FIG. 12 is a figure similar to that of FIG. 7 showing the bolt in the lock position.

Referring to FIG. 12, a pulse of current on the electromechanical actuator 68 (shown in FIG. 4) provided by a central controller 21 will then cause the bolt 30 to move in the extension direction 67' moving the pin 74 away from its resting position on the trough 77 down a right-hand side 80 of the track 72 as indicated by the dotted line. Pole 54 is still disconnected from terminal **56*a*. When the current to the electromechanical actuator 68 ceases, the spring 57 urges the bolt 30 inward and the pin 74 moves upward to be captured by trough 86** preventing further retraction.

Figure 13:
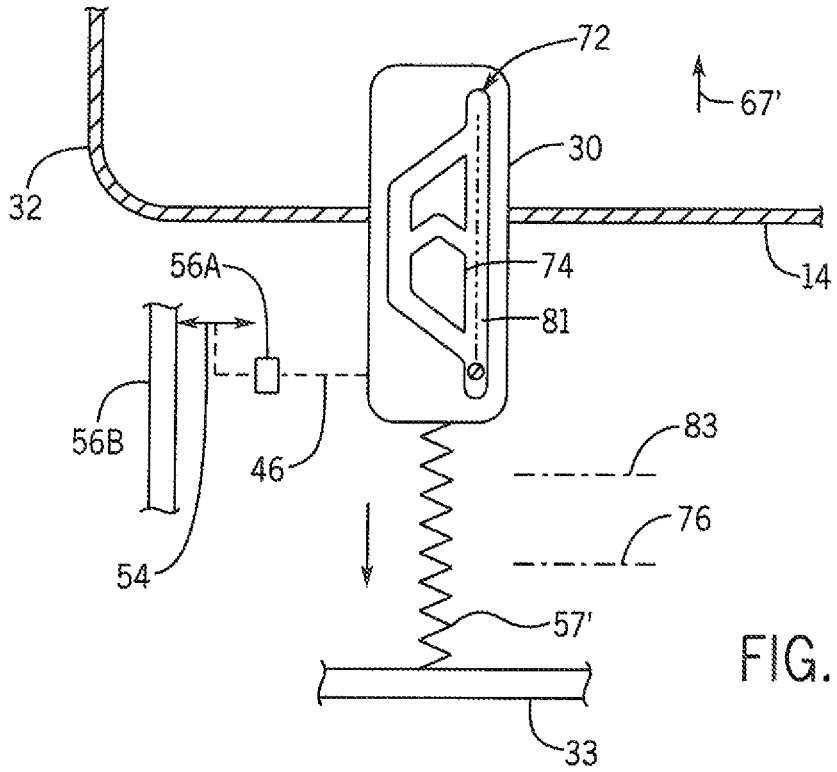
FIG. 13 is a figure similar to FIG. 9 showing the bolt in the over travel position.

Alternatively, referring now to FIG. 13, if the lid 12 is not closed or if the end of the bolt 30, for example, is broken off, after cessation of the retraction direction 67' upon a pulse of current to the electromechanical actuator 68, the bolt 30 will pass outward unimpeded by the stop 34 to beyond the lock position 83. This is allowed because of continuation of central track 81 substantially beyond the distance required for the bolt 30 to extend to the lock position 83. The result is that the pole 54 moves beyond terminal **56*a*, again breaking any lock signal so as to indicate to the central controller 21 that the lid 12** is not properly locked.

Upon cessation of the current to the electromagnetic actuator 68, the pin 74 will move back to his position shown in FIG. 11 with the bolt 30 fully retracted. In this way the bolt 30 is protected from damage when the lid 12 is closed.

Figure 14:
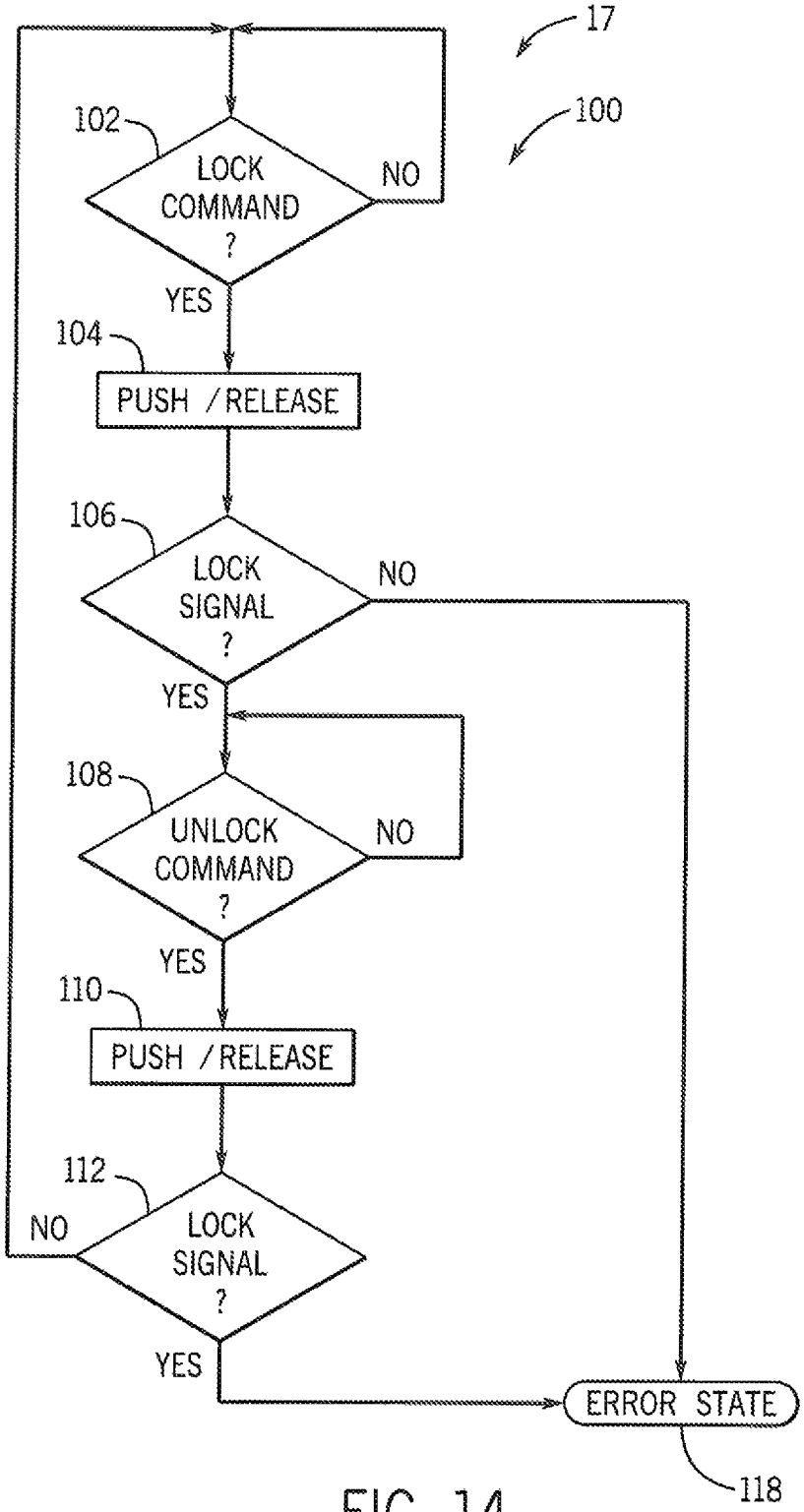
FIG. 14 is a figure similar to that of FIG. 10 showing a program executed by the controller for control of the electric lock of FIGS. 11-13.

Referring now to FIGS. 3, 4 and 14, stored program 100 executed by the controller 21 may operates similarly to that described with respect to FIG. 10 with the exception that if after the lock actuation of process block 104, there is no lock signal per decision block 106, and error may be entered into immediately without the need to retract the bolt 30 which is automatically retracted by the force of the spring 57'.

It is specifically intended that the present invention not be limited to the embodiments and illustrations contained herein, but include modified forms of those embodiments including portions of the embodiments and combinations of elements of different embodiments as come within the scope of the following claims. It is specifically intended that the present invention not be limited to the embodiments and illustrations contained herein, but include modified forms of those embodiments including portions of the embodiments and combinations of elements of different embodiments as come within the scope of the following claims.

Various features of the invention are set forth in the following claims. It should be understood that the invention is not limited in its application to the details of construction and arrangements of the components set forth herein. The invention is capable of other embodiments and of being practiced or carried out in various ways. Variations and modifications of the foregoing are within the scope of the present invention. It also being understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention.

What is claimed is:

1. An electric lock for a household appliance having a door that may be locked when the door is in a closed position by receipt of a bolt extending along an axis from an appliance frame to be received by the door in the closed position, the electric lock comprising:

a housing fixable to the appliance frame;

a bolt attached to be movable with respect to the housing to extend to a lock position with respect to the appliance frame to the door in the closed position to lock the door and to retract to an unlock position with respect to the appliance frame to unlock the door allowing the door to move from the closed position to an open position;

an electromechanical actuator communicating with the bolt and actuable by an electric signal to urge the bolt along the axis:

a spring communicating with the bolt to urge the bolt along the axis and having a force sufficient to move the bolt when the electromechanical actuator is not actuated; and a bi-stable mechanical linkage attached to the bolt to hold the bolt at a stable position resisting movement by the spring and then to release the bolt from the stable position allowing movement by the spring with successive actuation of the electromechanical actuator;

wherein the bi-stable actuator operates to release the bolt to extend further beyond the lock position with respect to the unlock position to an over-travel position and further including contacts providing an electrical signal distinguishing between whether the bolt is in the unlock position or the over-travel position.

2. The electric lock of claim 1 wherein the electromechanical actuator operates only to provide force counter to the force of the spring.

3. The electric lock of claim 2 wherein the spring moves the bolt along the axis in extension and wherein the bi-stable actuator operates to release the bolt to extend beyond the unlock position upon a first actuation and following a first deactivation of the electromechanical actuator, and to hold the bolt at the unlock position upon a second actuation and following second deactivation of the electromechanical actuator.

4. The electric lock of claim 2 wherein upon release by the bi-stable mechanical linkage, the bolt extends to an over-travel position beyond the lock position when the door is not in the closed position and the bolt extends to the lock position when the door is in the closed position.

5. The electric lock of claim 4 farther including contacts providing an electrical signal distinguishing between whether the bolt is in the lock position or over-travel position.

6. The electrical lock of claim 5 wherein the contacts are closed when the bolt is in the lock position and not when the bolt is in the over-travel position.

7. The electric lock of claim 2 wherein the spring moves the bolt along the axis in retraction and wherein the bi-stable actuator operates to hold the bolt at the lock position upon a first actuation and following a first deactivation of the electromechanical actuator, and to release the bolt to retract to the unlock position upon a second actuation and following second deactivation of the electromechanical actuator.

8. The electric lock of claim 7 wherein when the bolt is in the unlock position, the bolt extends to an over-travel position beyond the lock position when the door is not in the closed position and the electromechanical actuator is actuated and the bolt extends to the lock position when the door is in the closed position.

9. The electric lock of claim 8 further including contacts providing an electrical signal distinguishing between whether the bolt is in the lock position or over-travel position.

10. The electrical lock of claim 9 wherein the contacts are closed when the bolt is in the lock position and not when the bolt is in the over-travel position.

11. The electric lock of claim 9 wherein the contacts include only a single contact pair allowing determination only of whether the bolt is in the lock position.

12. The electric lock of claim 1 wherein the bi-stable mechanical linkage includes a track and track-follower fixed respectively to one of the bolt and housing, the track follower interacting with the track to stably hold the bolt against the spring in at least one position.

13. The electric lock of claim 12 wherein the follower is a tip of a flexible spring.

14. The electric lock of claim 13 wherein the track is a groove in the bolt.

15. The electric lock of claim 1 wherein the electromechanical actuator includes an electric motor.

16. The electric lock of claim 15 wherein the motor is a DC permanent magnet motor having a series diode to operate with AC.

17. The electric lock of claim 16 wherein the motor communicates with the bolt by a pinion on a shaft of the motor engaging a rack on the bolt.

18. The electric lock of claim 1 further including a door strike retained on the door and interengaging with the bolt to lock and unlock the door when the door is affixed to the door strike.

* * * * *